US005443124A

United States Patent [19]

Wood et al.

[11] Patent Number: 5,443,124

[45] Date of Patent: Aug. 22, 1995

[54] HYDRAULIC PORT COLLAR

[75] Inventors: Edward T. Wood, Kingwood; Robert T. Brooks, Corpus Christi; Michael O. Dion, Houston; Derrel G. Gurley, Katy; Monty E. Harris, Azle, all of Tex.

[73] Assignee: CTC International, Houston, Tex.

[21] Appl. No.: 225,631

[22] Filed: Apr. 11, 1994

[51] Int. Cl.[6] ..... E21B 34/10

[52] U.S. Cl. ..... 166/374; 166/386; 166/319

[58] Field of Search ..... 166/374, 222, 319, 321, 166/386, 187, 387

[56] References Cited

U.S. PATENT DOCUMENTS

| | | | |
|---|---|---|---|
| 3,853,177 | 12/1974 | Mott | 166/187 X |
| 3,876,000 | 4/1975 | Nutter | 166/187 X |
| 4,109,725 | 8/1978 | Williamson et al. | 166/321 X |
| 4,257,484 | 3/1981 | Whitley et al. | 166/321 X |
| 4,279,306 | 7/1981 | Weitz | 166/187 X |
| 4,967,845 | 11/1990 | Shirk | 166/386 |
| 5,048,611 | 9/1991 | Cochran | 166/374 |
| 5,156,210 | 10/1992 | Roth | 166/319 |

*Primary Examiner*—Ramon S. Britts
*Assistant Examiner*—Frank S. Tsay
*Attorney, Agent, or Firm*—Donald H. Fidler

[57] ABSTRACT

A stage valve with particular use in cementing a well bore annulus where the stage valve has pressure operated valve member for opening a flow passage in the stage valve and the valve member has differential pressure areas which maintain the valve member open while a fluid moves through the flow passage in one direction and which can be closed by fluid moving in an opposite direction. The flow passage has a choke to develop a pressure differential from the flow of fluid. Spring members can be used with the valve member to close the flow passage when the pressure differential of the fluid flow in one direction is insufficient to maintain the valve member in an open position.

19 Claims, 5 Drawing Sheets

HYDRAULIC PORT COLLAR

RELATED APPLICATIONS

This application is related to the disclosure in U.S. Ser. No. 08/052,618, filed Apr. 23, 1993 and entitled "HYDRAULIC PORT COLLAR".

FIELD OF THE INVENTION

This invention relates to oil well completions and more particularly, to a hydraulic port collar system which has utility in the cementing of liners in a wellbore or for introducing cement or other fluids to a wellbore annulus at locations intermediate of the length of a liner string and at locations above,.below, and between inflatable packers.

BACKGROUND OF THE INVENTION

In oil well completions, it is common to line the borehole with a tubular metal liner and to cement the annulus between the liner and the borehole by injecting a liquid cement slurry under pressure through the bottom end of the liner into the annulus between the liner and the wellbore. The liquid slurry is moved up the annulus between the liner and the wellbore under pressure and subsequently sets up in the annulus to support the liner in the well bore. There are limitations as to the length or height of a column of cement which can be pumped into a well annulus. Where the length of the liquid cement column in an annulus is too long it is not uncommon to insert a stage cementing collar along the length of the liner. In this instance, a liquid cement slurry is first located between the end of the liner, and the stage collar. Next, the stage collar is opened and liquid cement slurry is injected into the annulus located above the stage collar. After cementing the upper annulus above the stage collar, the stage collar is closed off to prevent a return flow of the liquid slurry into the bore of the liner.

In other completion techniques, an inflatable well packer is disposed in a wellbore on a liner where an inflation liquid is utilized to inflate an elastomer element on the packer and where the elastomer element seals off the annulus of the wellbore. In some instances, it is desirable to have a stage valve above the inflatable packer so that cement can be introduced into the upper annulus between the liner and the wellbore above the inflatable packer.

Stage valves require the ability to remain closed during an initial operations and to be opened only at an appropriate time and to be closed securely at the end of an appropriate time. Stage valves typically include sliding sleeves and latches for retaining the sleeves in one position or another. The sleeves and latches can be mechanically activated or hydraulically activated.

In most types of cementing operations it is also common to leave cement in the liner which has to be drilled out. Thus, if cementing can be accomplished without leaving cement in the liner, there are substantial economic benefits to the operator.

PRIOR PATENT ART

U.S. Pat. No. 4,655,286 issued Apr. 7, 1989, to E. T. Wood (Class 166/396) discloses a cementing system which utilizes an inflatable packer and a cementing process for a liner.

U.S. Pat. No. 5,048,611 issued Sep. 17, 1991, to C. B. Cochran discloses a pressure operated circulation valve where a tubular valve member with flow ports has outer telescoping sleeve members and an inner ball seating members. By use of a first sealing ball and pressure, the outer telescoping sleeve members separate to open the flow ports. A second sealing ball and pressure enables movement of an outer sleeve to close the flow ports.

U.S. Pat. No. 4,880,058 issued on Nov. 14, 1989, to H. E. Lindsey (Class 166/289) discloses a stage valve which is pressure operated to open flow ports. The valve sleeve moves upwardly to open the ports and releases a locking mechanism. A cementing plug is used to shift the valve sleeve to a closed position.

SUMMARY OF THE INVENTION

The present invention is embodied in a hydraulic port valve or port collar which is preferably utilized with an inflatable packer and is selectively operable to introduce a liquid cement slurry or other fluids to the annulus between a liner and a well bore at the location of the port collar.

The port collar structure includes a central tubular support or valve mandrel which is connected into and is part of the cementing drill string or liner. The mandrel has circumferentially arranged flow ports and a full bore with respect to the liner. The flow ports are initially closed off by an outer tubular sleeve valve member which is slidably mounted on the support member. The sleeve valve member has an annular end sealing surface or valve seal which is retained in a closed position on an annular sealing element by a spring means. The sleeve valve member also has a tubular portion at an opposite end which is sealingly disposed in an seal annulus located between the support mandrel and an outer tubular housing. The tubular portion defines differential pressure areas with respect to the valve seal on the end of the valve member. Choke ports are provided in the outer housing and are aligned with the flow ports in the support mandrel.

When pressure is applied in the bore of the support member, the pressure is applied through the flow ports. When the pressure in the bore exceeds the pressure external to the housing, the outer sleeve valve member can be moved by the force on the differential areas from a closed position so that the flow ports are placed in fluid communication with the choke ports in the outer housing. The fluid flow through the choke ports produces a pressure differential across the tubular portion of the sleeve valve which overcomes the closing force of the spring and holds the valve sleeve member in an open condition.

A cement slurry is used to provide the pressure and passes through the flow ports to fill an annulus between the outer housing and the well bore. When the cement slurry is discontinued the pressure holding the sleeve valve member in a open position is released so that, the spring force on the sleeve member positively closes the flow ports with respect to the exterior of the valve member. In another, aspect, when the pressure is reduced below the back pressure in the annulus, a reverse flow can occur so that the differential areas cause the sleeve valve member to close. In this instance a spring force is not utilized.

A releasable and slidable inner sleeve member is disposed in a recessed portion of the bore of the support mandrel and is movable into a position closing off the flow ports in the support mandrel. The inner sleeve member can be locked in a closed position. With the flow ports closed off internally and externally, differential pressure will not move the closed valve member.

In a broader aspect of the present invention, the port collar and one or more inflatable packers can be operated by an inflation tool. For example, a port collar can be disposed between two inflatable packers. By using an inflation tool on a string of tubing, the respective packers can be inflated with an inflation liquid on a first trip in the well bore. In a second trip in the well bore with the inflating tool on a string of tubing, cement slurry can be injected through the port collar so that the annulus between the inflated packers can be filled with cement. When the annulus is filled with the cement slurry, the port collar is closed off. Then, the string of tubing and inflation tool are returned to the surface together with the cement slurry, or alternatively, the cement slurry can be reversed out of the tubing string and, in either case, no cement is left in the well bore.

A single inflatable packer and port collar can be operated by an inflation tool. An inflation tool will utilize a profile recess associated with a packer and a port collar to locate the tool. The inflation tool can utilize either cup type or weight set packing elements.

DESCRIPTION OF THE PRESENT INVENTION

Figure 1A:
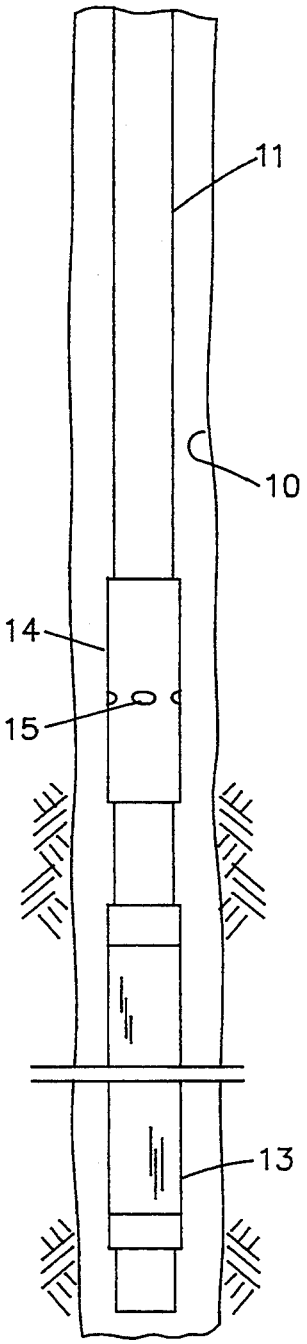
FIGS. 1 (A)-(B) are schematic illustrations of an inflatable packer with a hydraulic port collar: (A) prior to inflating the packer; (B) after the packer is inflated; with the hydraulic port collar open.
Figure 1B:
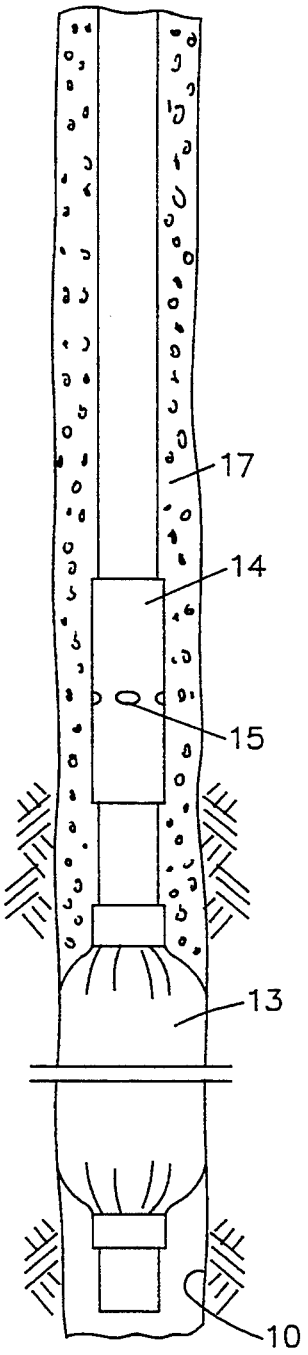

Referring now to FIG. 1A, a wellbore 10 is illustrated with a liner 11 disposed in the wellbore where the liner carries an inflatable packer 13 along its length and a hydraulic port collar 14 is located in the liner string just above the inflatable packer 13. At the desired location in the wellbore to inflate the packer 13, a liquid cement slurry (or other inflating liquid) is pumped through the liner under pressure to inflate the inflatable packer 13 into a sealing condition on the wellbore 10 (See FIG. 1B). The hydraulic port collar is designed to remain closed under this cement slurry pressure. An inflatable packer of the type contemplated can be found in U.S. Pat. Nos. 4,655,286 or 4,420,159 where a pressure operated valve is utilized rather than a knock off plug to control access of inflating liquid to the well packers.

After the packer is inflated, pressure on the cement slurry or other fluid in the liner 11 is utilized at a selected valve to open a port collar valve to place choke ports 15 in the exterior of the valve in fluid communication with the bore of the liner 11 and in an open position so that a cement slurry 17 can be pumped under pressure into the annulus. At the completion of the operation, the pressure is decreased below the selected value and an interior valve sleeve is moved to close the choke ports 15.

Figures 2, 3, 4:
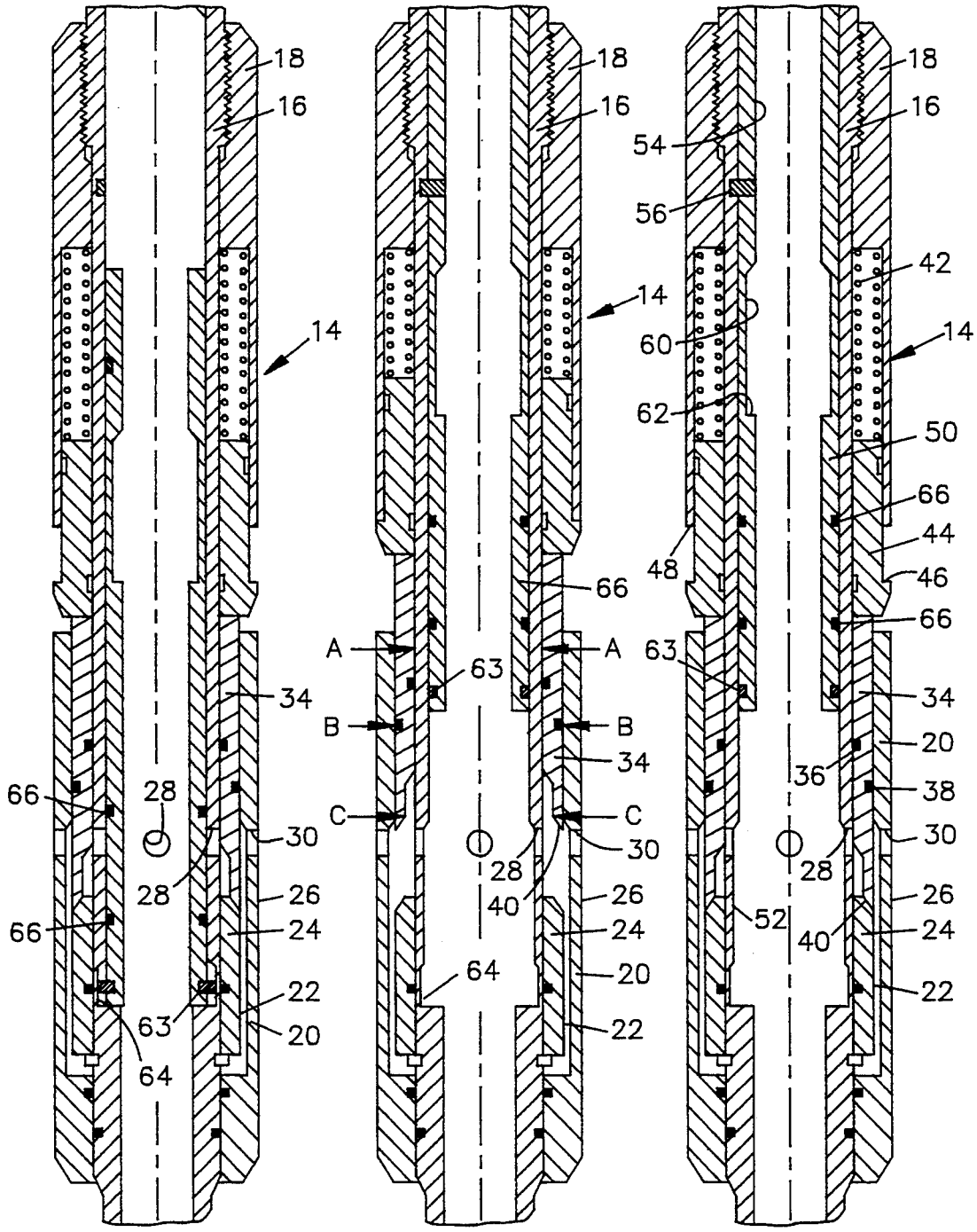
FIG. 2 is a schematic view in partial longitudinal cross-section through a hydraulic port collar embodying the present invention in a closed condition.
FIG. 3 is a schematic view similar to FIG. 2 showing the port collar of FIG. 2 in an open position during cementing.
FIG. 4 is a schematic view similar to FIG. 3 but showing the port collar in a closed position after cementing.
Figure 5:
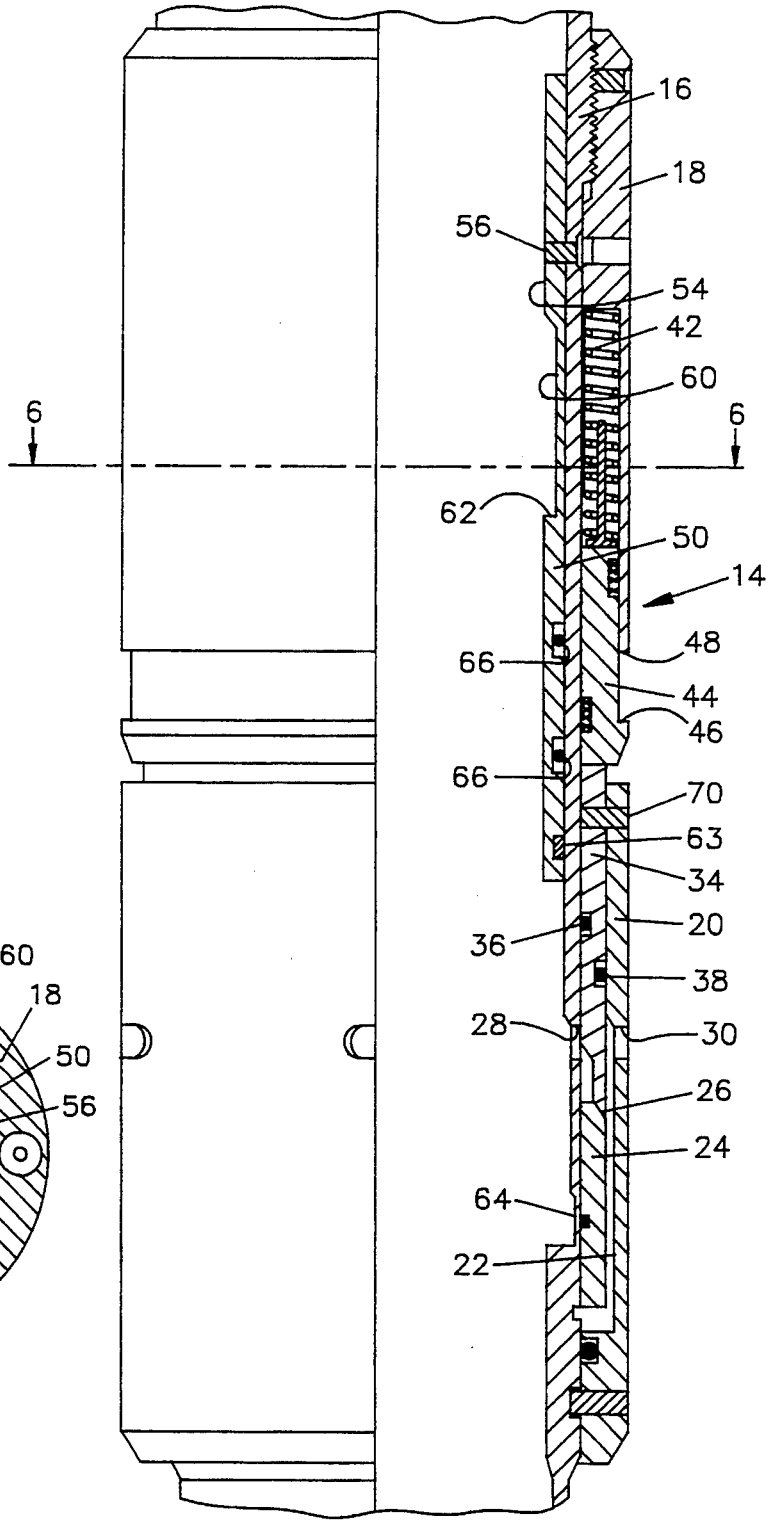
FIG. 5 is an enlarged view in partial cross-section through a port collar embodying the present invention.

Referring now to FIGS. 2, 3, and 4, a port collar valve 14 embodying the present invention is shown in various operating positions and an enlarged cross-section of the port collar 14 is shown in FIG. 5. The port collar 14 includes a tubular central valve member which is adapted for coupling with and supporting a liner or string of pipe. On the exterior of a tubular mandrel 16 there is a tubular spring housing 18 which is longitudinally spaced on the mandrel 16 from a tubular valve housing 20. The valve housing 20 is attached to the mandrel 16 and has an annular seal bore or seal annulus defined between the outer wall surface of the mandrel 16 and the inner wall surface of the valve housing 20. Adjacent to the seal annulus is an inner counterbored recess 22 in the inner wall of the valve housing 20. A tubular lower sealing member 24 is mounted on the mandrel 16 and is disposed in the recess 22. The sealing member 24 has an upwardly facing annular sealing ring 26. Just above the sealing ring 26 are flow ports 28 which are located in the mandrel 16 and choke ports 30 which are located in the valve housing 20. The flow ports 28 and the choke ports 30 are in radial alignment with one another. Above the ports 28 & 30, the seal annulus is defined between the inner wall surface of the housing 20 and the outer wall surface of the mandrel 16. A tubular sleeve valve member 34 is slidably and sealingly disposed in the seal annulus. The valve sleeve member 34 has inner and outer seals 36, 38 which respectively define cross-sectional seal areas A & B (see FIG. 3). At the lower end of the valve sleeve member 34 is an annular valve sealing surface 40 which engages the sealing ring 26 in a closed condition of the valve. In the closed condition of the sleeve valve member, the valve sealing surface 40 defines a cross-sectional sealing area "C" which is intermediate in size to the cross-sectional areas A & B.

As shown in FIG. 2, valve member 34 is normally held in a closed condition by a spring means 42 in the spring housing where the spring means 42 act on a tubular spacer member 44 which engages the end of the valve member 34. The spacer member 44 has an upwardly facing, outer flange 46 which limits upward movement of the spacer member when the valve member 34 is moved to an open position and compresses the spring means 42. The flange 46 will engage an end surface 48 of the spring housing 18 to limit it's upward travel.

An tubular inner closing sleeve member 50 is slidably disposed in an annular recess 52 in the bore of the valve mandrel 16. The inner bore 54 of the sleeve member 50 is sized to the inner bore of the string of pipe 11. The sleeve member is shown in FIG. 2 as disposed in a upper position and releaseably held there by a shear pin 56. Intermediate of the length of the sleeve member 52 is an internal annular recess 60 which has an upwardly facing shoulder 62 for engagement with a latching dog (not shown) on a shifting tool. At the lower end of the sleeve member 52 is a snap ring 63 located in a recess in the outer wall where the snap ring is arranged to engage with a latching recess 64 in the valve mandrel 16 when the sleeve member is shifted a lower position. Seal means 66 are provided in the wall of the sleeve member 50 to straddle the flow ports 28 when the sleeve member is in a lower position.

Figure 6:
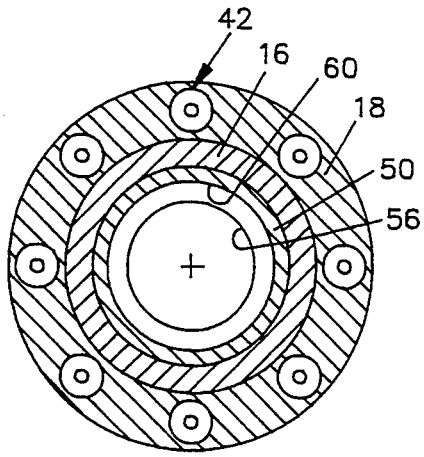
FIG. 6 is a view in cross-section taken along line 6—6 of FIG. 5.

As shown in further detail in FIG. 5 and FIG. 6, the housing 18 has circumferentially located, axially extended blind bores to receive compression springs and guide elements. The spacer member 44 is provided with inner and outer annular Teflon debris blocks for keeping debris from entering the housing 18. If desired, a shear pin 70 can be used with the valve member 24 and the housing 20 to regulate the force required to open the valve. With a shear pin 70, the pressure must overcome the shear strength of the shear pin as well as the force of the springs to open the valve.

When it is desired to open the flow ports 30 in the port collar, pressure is developed in the liner to exceed the strength of the shear pin 70 (see FIG. 5) (if a shear pin is used) and pressure across the areas A & C causes the shear pin 70 to shear and the spring means 42 to compress. The pressure can be developed by use of cementing plugs or straddle tools which will be described hereafter. The pressure opens the port collar valve and places the flow ports 28 in fluid communication with the choke ports 30. When the sleeve member 34 is forced to an open position, fluid flows through the choke ports 30 and there is a drop in pressure. The drop in pressure maintains a differential pressure across the differential areas A & B on the outer sleeve members. The continued flow of fluid maintains a force which holds the valve open by pressure on the sleeve member 34. The springs 42 positively close the valve when the cementing is completed and the pressure on the fluid is reduced to a level where the force of the differential pressure on the sleeve member 34 is less than the spring force. The external pressure across the seal areas A & C also holds the valve closed. It will be appreciated that the external pressure includes the hydrostatic pressure of the cement slurry. The springs 42 are additional precaution, as the reduction in internal pressure to permit a back pressure flow from the exterior will act on the differential area to move the sleeve member 34 to a closing position.

The choke ports 30 are sized in area relative to the flow volume to obtain the desired pressure differential on the valve. The flow ports 28 are made as large as necessary to permit the pressure drop across the ports 30 to occur. To size the area of the ports 30, they can be oblong in a transverse direction.

In a co-pending application Ser. No. 08/040345, filed Mar. 30, 1992 entitled HORIZONTAL INFLATION TOOL, a cup type inflation tool with a selectively operated valve for the inflation of inflatable packers is disclosed. The cup type inflation tool is run on a string of tubing to a location within an inflatable packer and selectively operated to admit cement slurry to the inflatable packer for inflation of the packer. After inflating the packer, the cement slurry can be reversed from the string of tubing by use of a circulation valve in the tubing string and the tool is retrieved on the string of tubing so that no cement is left in the liner.

Figure 8:
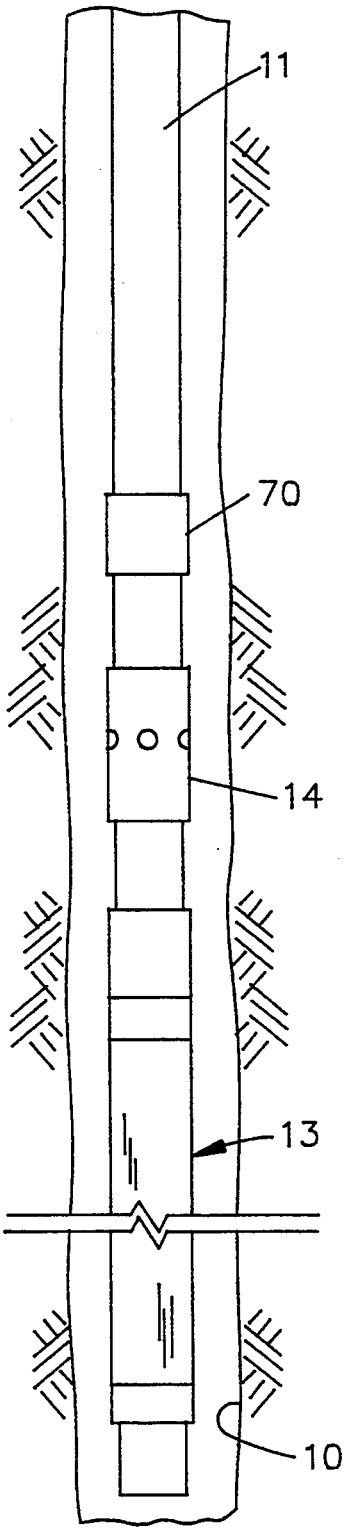
FIG. 8 is a schematic illustration of a well bore in which an inflatable packer is located below a hydraulic port collar.

Referring now to FIG. 8, an inflatable packer 13 is shown as disposed in a wellbore 10. Above the packer 13 is a port collar 14 of the present invention. Above the port collar 14 is tubular profile sub 70, which in turn is connected to a string of pipe or liner 11.

Figure 7:
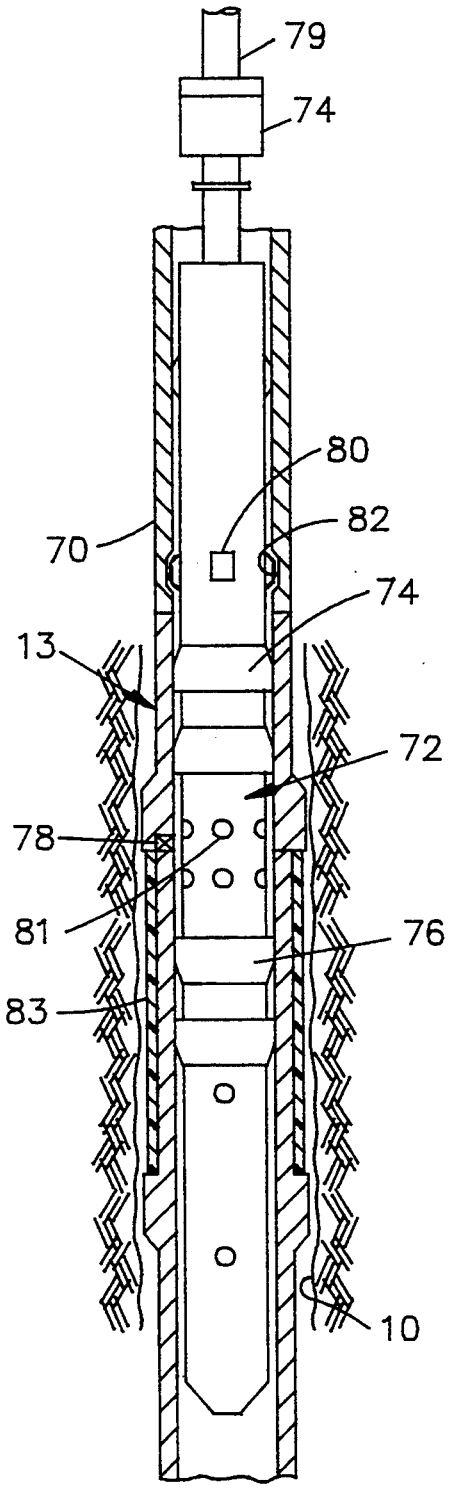
FIG. 7 is a schematic view of a cup type straddle inflation tool for use with inflatable packers and a hydraulic port collar to eliminate leaving cement in the liner.

As shown in FIG. 7, a cup type inflation tool 72 as disclosed in Ser. No. 08/040345 includes opposite facing sealing cup members 74, 76 which are arranged to straddle a valve opening for a pressure operated valve means 78 in the inflatable packer 72. The inflation tool has an upper latching means or latching dog members 80 which cooperate with an annular latching profile recess 82 in a profile sub member 70 to releasably position the inflation tool 72 relative to the valve means 78 in the adjacent packer. The inflation tool 72 is disposed in the liner by a string of tubing 79.

The inflation tool 72 is lowered by the string of tubing 79 to position and releasably lock the latching means in the profile recess 82. The cup members 74, 76 straddle or isolate the inflation valve means 78 in the bore of the inflatable packer 72. A valve means (not shown) in the inflation tool 72 is then activated so that a cement slurry in the string of tubing 79 can be introduced through valve ports 81 in the inflation tool to access the inflatable packer valve means 78 and thereby to expand the packer element 83 into sealing engagement with the wall of the well bore 10.

After expanding the inflatable packer element 83, the latching means 80 are released from the profile recess 82, the valve means 78 are closed and the tool 72 is raised to a profile sub 70 located above the port collar 14 (See FIG. 8). The inflation tool 72 is then repositioned so that the latching means 80 are in a profile recess in the profile sub 70 and the cup members 74, 76 straddle the valve ports 28 of the port collar 14. The valve means in the inflation tool 72.are again opened so that cement slurry can be introduced through the port collar 14 to the annulus in the well bore above the inflated packer 13. Upon completion of the cementing through the port collar 14, the pressure is reduced and the valve ports 28 in the port collar 14 are closed off. The spring members 42 in the port collar move the valve member 34 to a closed position. The inflation tool 72 is lowered and the anchor members 80 are used to engage with the shoulder 62 in the inner sleeve member 50 to move the inner sleeve member 50 to a closed and locked condition. The tool 72 is then raised to a blank section of pipe and a reverse circulation valve 79 is opened and the cement slurry is reversed out through the string of tubing by pumping liquid down the annulus. Thus, no cement is left in the well bore from the operation.

In U.S. Pat. No. 5,082,062, an inflation tool for inflation of inflatable packer with expanding weight set packer elements and a selectively operated valve is disclosed. This inflation tool is run in on a string of tubing and has a selectively operated valve for admitting cement slurry to an inflatable packer. Both the weight set inflation tool and the cup type inflation tool permit inflation without leaving cement in the liner.

Figure 9:
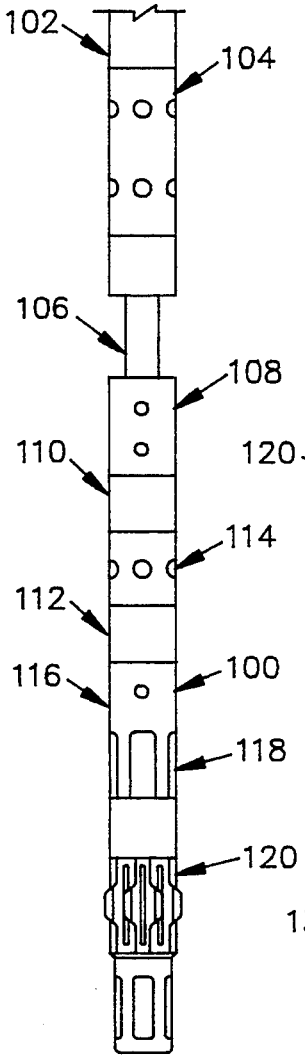
FIG. 9 is a schematic illustration of a weight set straddle inflation tool for use with inflatable packers and the hydraulic port collar.

As shown in FIG. 9, a weight set inflation tool 100 as shown in U.S. Pat. No. 5,082,063 can be located or suspended in a well bore (not shown) on a string of tubing 102. The tubing string 102 is connected to a pressure operated reverse circulation valve 104. The circulation valve 104 is connected to a central tubular activating member 106. The activating member 106 is slidably received in an upper expander collar 108. Below the expander collar 108 are upper and lower packer elements 100, 112 which straddle a valve port 114. A lower expander member 116 connects to anchor means 118 and to a locating means 120.

Figure 10:
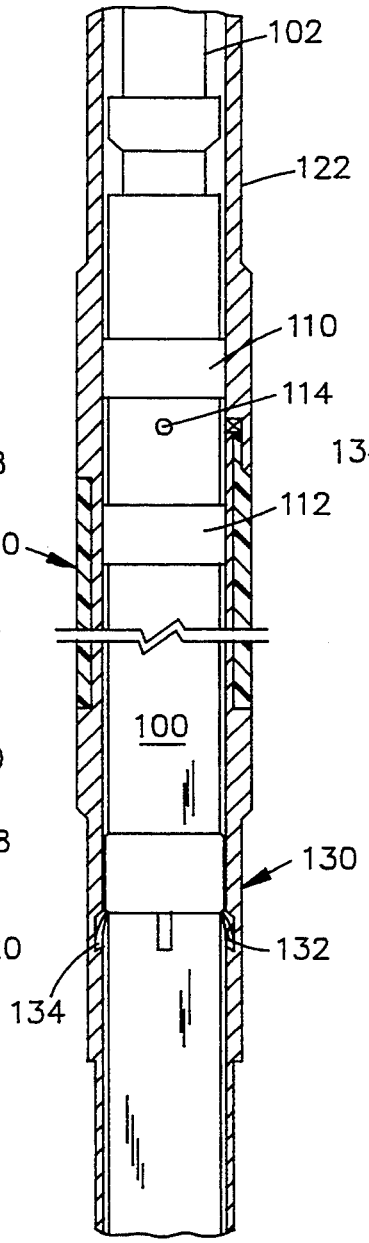
FIG. 10 is a schematic illustration of an inflatable packer and weight set straddle tool in an operational condition.

In the pipe string 122 (see FIG. 10) a profile sub 130 includes an inner annular latching groove 132 which cooperates with dog members 134 on the inflation tool 100. In typical arrangement as shown in FIG. 10, dog members 134 on the tool 100 are resiliently biased outwardly so that upon downward movement, the projecting ends of the dog members engage the profile groove 132 and the packer elements 110, 112 can be expanded by applied weight on the string of tubing 102. When the packer elements 110, 112 are expanded, a valve means (not shown) in the tool 100 is activated so that a cement slurry in the string of tubing can be pumped through valve ports 114 to inflate an inflatable packer element 120 on the packer 150.

Figure 11:
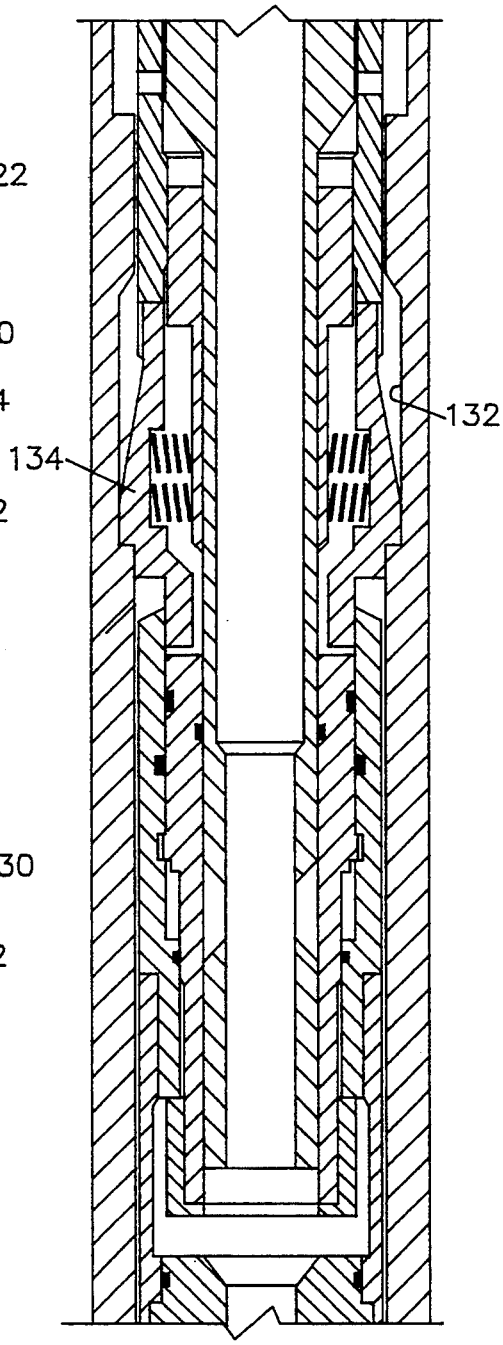
FIG. 11 is a cross-section view showing the anchor means for the weight set straddle tool of FIGS. 9 & 10.

In the above described system, the dog members 134 are normally retained within the housing while the tool is run in the well bore. After disposing the tool below the lowermost profile, the dog members are released to be resiliently biased outwardly (see FIG. 11 for details). The tool is operated from the lowermost profile upwardly by raising the dog members above a profile recess and moving downward which causes the dog members to engage the recessed so the packer elements can be set by weight.

In practicing the method using the arrangement of FIG. 9, a port collar profile (not shown) is located in the string of pipe at a location below the port collar. The dog members 134 are then engaged with the profile and the packer elements 110, 112 straddle the access ports 28. The valve in the tool 100 is then activated to access a cement slurry in the string of tubing into the port collar ports 28 to introduce a cement slurry to the annulus about the port collar. When the cementing is completed, the tool 100 is raised and then lowered so that the dog members 134 engage the shoulder 62 on the inner sleeve of the port collar and close the valve. The circulation valve 104 is then opened and cement in the string of tubing is reversed out leaving no cement in the well bores.

It should be appreciated that the cup type tool can perform the steps of inflating the inflatable packers and injecting cement slurry through the port collar with one trip in the well bore. Whether a cup type tool or weight set tool is utilized is dictated many times by well conditions where one tool will perform superior to the other because of many factors. In any event, by appropriately locating the profiles relative to the packers, either tool can be used as the situation may dictate.

Figure 12:
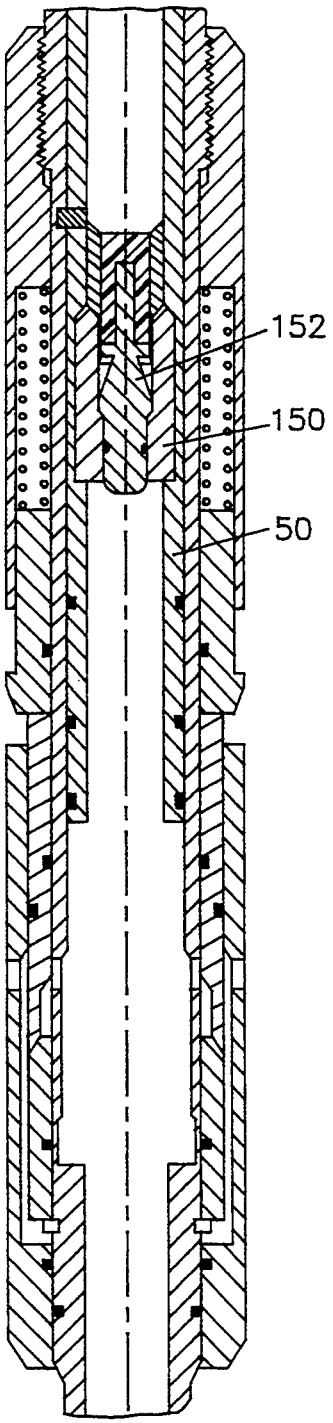
FIG. 12 is a partial view in cross-section of another type of closing system which can be used with the port collar.

Referring now to FIG. 12, another the form of the present invention is illustrated where the bore of the inner sleeve 50 is fitted with a drillable plug catcher 150. In operation, a cementing plug 152 can be pumped down the string of pipe behind the cement slurry and used to pump the sleeve 150 to a closed position.

It will be apparent to those skilled in the art that various changes may be made in the invention without departing from the spirit and scope thereof and therefore the invention is not limited by that which is enclosed in the drawings and specification, but only as indicated in the appended claims.

We claim:

1. A valve apparatus for use in cementing operations in a well bore, said valve apparatus including:

a tubular valve member having flow ports located intermediate of its length, said valve member being adapted for connection in a well string and being subject to hydrostatic pressure in the well bore internal and external to the valve member;

a tubular spring housing and a tubular valve housing disposed on said valve member in a spaced apart arrangement;

said valve housing having choke ports aligned with said flow ports and defining a flow passage between the interior of said valve member and the exterior of said valve member;

a valve element having a tubular portion disposed in an annular space defined by spaced apart walls in said valve housing and a valve portion for closing off said flow passage, said tubular portion being open to the well bore external to said valve member;

said valve element being movable on said valve member between a first longitudinal position closing said flow passage and a second longitudinal position opening said flow passage;

spring means in said spring housing for releasably retaining said valve element in said first position with a resilient force;

said valve portion having first seal means operative in said first position for closing said flow passage;

second seal means disposed between said tubular portion of said valve element and said spaced apart walls;

said second seal means defining a pressure area on said tubular portion with respect to said first seal means whereby fluid pressure in said valve member can develop a force acting on said valve element to overcome the resilient force of said spring means and move the valve element toward the second position and so that fluid flow through the choke ports can develop a pressure drop across the choke ports which acts on a differential pressure area defined by said first seal means and said second seal means to maintain the valve element in a second position so long as the force on the differential pressure area caused by the pressure drop across the choke ports is sufficient to overcome the force of the spring means.

2. The valve apparatus as set forth in claim 1 and further including shear means for releasable connecting said valve element to said valve member so that the force required to open the flow passage is greater than the force of the spring means and the force to shear the shear means.

3. The valve apparatus as set forth in claim 1 and further including an inner closing sleeve member slidably disposed in the bore of said valve member, said inner sleeve member being movable longitudinally between a first position where said flow ports are open and a second position where said inner sleeve member closes said flow ports.

4. The apparatus as set forth in claim 1 wherein said spring means includes a spacer member disposed between one or more spring elements and the valve element.

5. The apparatus as set forth in claim 4 wherein the spacer member has a stop shoulder to limit movement of said valve element to said second position.

6. The valve apparatus as set forth in claim 3 and further including locking means for locking said inner sleeve member in said first and second positions and where said locking means releasably locks said inner sleeve member in said first position.

7. The valve apparatus as set forth in claim 6 wherein said locking means includes a shear pin for releasably locking said inner sleeve member in said first position and includes a snap ring for receipt in a locking recess for locking said inner sleeve in said second position.

8. A valve apparatus for use in cementing operations in a well bore, said valve apparatus including:

a tubular valve structure having flow ports and choke ports respectively located in spaced apart inner and outer annular walls of said valve structure where said inner wall defines a bore, said ports being in alignment and defining a flow passage, said ports being located intermediate of the length of said valve structure, said valve structure being adapted for connection in a well string and subject to internal pressure in said bore and pressure in the well bore external to said valve structure;

valve means disposed intermediate of said annular walls and including a tubular valve sleeve member slidably mounted between said annular walls for movement between a first position closing said flow passage and a second position opening said passage, said valve sleeve member being responsive to pressure in the bore of the valve structure for moving said valve member longitudinally to a second position where said flow passage is opened; and annular seal means on said valve sleeve member for engaging said inner and outer walls, said valve sleeve member being in communication with pressure in the well bore external to said valve structure for providing a differential pressure area on said valve sleeve member where said differential area is responsive to a pressure differential developed by sufficient fluid flow through said flow choke ports for holding said valve sleeve member in said second position.

9. The valve apparatus as set forth in claim 8 and further including:

resilient means acting on said valve sleeve member for returning said valve member to said first position when the differential pressure of said fluid flow is relieved.

10. The valve apparatus as set forth in claim 9 and further including an inner closing sleeve member in the bore of said valve structure, said inner closing sleeve member being movable between first and second positions where said flow ports are respectively opened and closed.

11. The apparatus as set forth in claim 9 wherein valve sleeve member has a seal area in the first position which is sized intermediate the respective seal areas of said valve sleeve member and where the choke ports are sized to a flow volume of a fluid flow to create sufficient force by a pressure drop through the choke ports to maintain the valve sleeve member in said second position.

12. The apparatus as set forth in claim 10 wherein the inner closing sleeve member has an internal recess for providing a shoulder sized for engagement with a latching dog member on a wireline shifting tool.

13. The apparatus as set forth in claim 10 wherein the inner closing sleeve member has a plug receptacle for receiving a cementing dart.

14. The valve apparatus as set forth in claim 9 and further including shear means for releasably connecting said valve sleeve member to said valve structure.

15. A method for displacing a liquid into a well bore annulus at a location along a string of pipe where a pressure operated valve is at the location and there is a liquid under pressure in the annulus comprising the steps of:

disposing a string of pipe with a pressure operated valve at a location in a well bore where it is desired to introduce a first liquid into the annulus about said location and where the annulus has a second liquid under pressure;

supplying a flow of the first liquid to the location through the string of pipe and developing a pressure in the bore of the string of pipe which is sufficient to longitudinally displace a movable sleeve member in said pressure operated valve to move the sleeve member from a closed position to an open position and to place flow ports in the valve in fluid communication with choke ports in the valve in the open position of the sleeve member and to place a differential pressure area on the sleeve member in communication with a pressure drop developed by said choke parts;

maintaining a flow of the first liquid through said choke ports and into the second liquid in the annulus sufficient to develop a differential pressure across the choke ports to act on the sleeve member and to hold the sleeve member in the open position while the flow is maintained through the choke ports.

16. The method as set forth in claim 15 and further including the step of:

reversing the flow of liquid through the choke ports to develop a differential pressure to move the sleeve member to a closed position.

17. The method as set forth in claim 16 wherein the valve has an inner closing sleeve member and further including the step of shifting the inner closing sleeve member in the valve with respect to the flow passage to close the flow passage.

18. The method as set forth in claim 17 and further including the step of:

decreasing the flow of liquid and providing a mechanical force on said sleeve member to move the sleeve member to a closed position when the mechanical force overcomes the force developed on the sleeve member by the differential pressure across the choke ports.

19. The method as set forth in claim 18 wherein the valve has an inner closing sleeve member and further including the step of shifting the inner closing sleeve member in the valve with respect to the flow passage to close the flow passage.

* * * * *